United States Patent [19]

Jenn

[11] Patent Number: 4,723,383

[45] Date of Patent: Feb. 9, 1988

[54] ROOF STRUCTURE FOR HOUSING UNITS

[75] Inventor: Louis J. Jenn, Indianapolis, Ind.

[73] Assignee: Atrium Structures Inc., Indianapolis, Ind.

[21] Appl. No.: 786,196

[22] Filed: Oct. 10, 1985

[51] Int. Cl.[4] ..... E04B 1/32

[52] U.S. Cl. ..... 52/88; 52/309.4

[58] Field of Search ..... 52/80, 86, 88, 79.4, 52/309.4, 89, 309.1, 200

[56] References Cited

U.S. PATENT DOCUMENTS

| | | | |
|---|---|---|---|
| 887,284 | 5/1908 | Stoffer | 52/89 |
| 1,185,871 | 6/1916 | Broughton | 52/89 |
| 2,816,329 | 12/1957 | Sogaro | 52/309.1 |
| 2,871,521 | 2/1959 | Messmore | 52/80 |
| 3,284,969 | 11/1966 | Walters | 52/80 |
| 3,905,167 | 9/1975 | Watkins | 52/79.4 |
| 3,953,949 | 5/1976 | O'Sheeran | 52/82 |
| 4,441,291 | 4/1984 | Sokoler | 52/200 |

FOREIGN PATENT DOCUMENTS

| | | | |
|---|---|---|---|
| 217678 | 3/1961 | Austria | 52/88 |
| 450951 | 8/1949 | Italy | 52/86 |
| 560990 | 5/1944 | United Kingdom | 52/86 |
| 2124277 | 6/1983 | United Kingdom | 405/126 |

*Primary Examiner*—Henry E. Raduazo

*Attorney, Agent, or Firm*—Woodard, Emhardt, Naughton, Moriarty & McNett

[57] ABSTRACT

A molded roof section for use with dwelling units includes a domed main body portion which is arranged with a leading edge, an opposite trailing edge, and two side edges. The leading edge is configured with strengthening ribs and a defined groove while the trailing edge also including strengthening ribs is configured with a tongue such that the leading edge of one roof section may be assembled to the trailing edge of the contiguous roof section by a tongue-in-groove assembly concept. The side edges of said roof section are arranged with downwardly opening channels which are spaced so as to correspond to the spacing between dwelling unit side walls. Each roof section is molded of a high-density polymer foam as a homogeneous, unitary member and each roof section may be easily and readily lifted in place and lowered onto the side walls such the side walls fit into the downwardly opening channels of each section. In order to complete the entire roof for the dwelling, additional molded roof sections are applied, each additional section being assembled to the dwelling in a similar manner.

2 Claims, 8 Drawing Figures

ROOF STRUCTURE FOR HOUSING UNITS

BACKGROUND OF THE INVENTION

Although multiple-unit housing has long been recognized for its space efficiency and maximum utilization of land, the last 20 years has seen a significant increase in the number of multiple-unit housing starts wherein the building modules are substantially preconstructed in a plant and then transported to a location where they are assembled.

Representative of this type of construction and concept is the housing arrangement disclosed in my prior U.S. Pat. No. 3,629,983. This prior patent discloses a particular arrangement of dwelling units wherein the units are arranged in such a manner as to generally enclose an open-air court. The units have a staggered assembly. corner to corner, in the shape of a square or quadrangle where an end of one unit abuts the side of an adjacent unit, and so forth until the courtyard area is enclosed by a total of four units. Alternatively, a single-family dwelling may have its individual rooms arranged in a sequential single-file manner on three or four sides of the courtyard, thereby preserving the same housing concept.

The preconstructed, multiple-unit housing disclosed in my prior patent included variations such as adding a second story and creating walkways to and from the open-air court. While still utilizing the basic concepts of an enclosed courtyard, it is envisioned that improvements can be made to the structure in the type of construction and architectural designs which are possible.

Although the atrium courtyard which is able to be created by arranging such units in a surrounding manner provides one benefit to this type of housing, the overall cost effectiveness is another benefit. The concept of preconstructed building modules which are remotely built and then moved to the site location enables more of a production line approach and less skilled labor at the site location.

One cost factor though which has remained a concern, whether or not the units are preconstructed and whether or not the units are single-wide, is the cost of roof construction. Generally speaking, a conventional roof requires seven major steps in its fabrication and construction procedure. These seven steps are typically the same regardless of whether the housing units are single-wide, preconstructed or conventional housing of any width, and the present invention which discloses an improved roof design for housing units is equally applicable to any type of style of housing unit.

As is believed to be well known, conventional roof construction requires that ceiling joists and rafters be individually measured, cut, positioned and nailed in place. Drywall is applied for the interior ceiling and insulation is introduced at appropriate locations, such as between ceiling joists. Sheathing and building paper are applied over the rafters, followed by the application of shingles. While the time to perform the above steps is one concern, the necessary skilled labor and material costs present other concerns. If the focus of a particular construction project is on low cost and a short construction time, then conventional roof construction is a significant factor in that it represents higher cost and more time.

The present invention offers an improved roof design which eliminates all of the seven basic steps which are required for conventional roof construction. Although the present invention is illustrated in combination with single-wide housing and an atrium courtyard arrangement, it is to be understood that the roof construction which is disclosed herein is equally applicable to any type of housing or dwelling units regardless of their overall width and regardless of whether or not those housing units are arranged so as to define an atrium courtyard.

One reason why the present invention has been illustrated in combination with a plurality of single-wide dwelling units, arranged as a single-family dwelling defining an atrium courtyard, is due to the fact that this type of construction is particularly well-suited to the present invention. Single-wide, preconstructed housing, may range from 10 to 16 feet in width. The criteria is that the width not excede the maximum applicable over-the-road width for the particular state or states through which the housing must be transported from the fabrication site to the installation site. In view of the fact that many over-the-road width limitations are either 12 or 14 feet, an individual roof section according to the present invention need only span the 14-foot width, and individual roof sections according to the teachings of the present invention can be easily molded as single, unitary units.

In the event the roof construction according to the present invention is to be adapted to housing units which are not single-wide, the tongue-in-groove concept which is used to join individual roof sections together as they extend along the length of the individual housing units can be employed along the roof section sides as well as along the section ends. By using a similar joining concept to place two individual roof sections side by side along the width of the individual housing units, virtually any length and any width can be accommodated.

SUMMARY OF THE INVENTION

A molded roof section for use with dwelling units which includes spaced side walls according to one embodiment of the present invention comprises a main body portion which is arranged with a leading edge, an opposite trailing edge and two side edges, the leading edge is designed and arranged to fit within the trailing edge of a first contiguous roof section, the trailing edge is designed and arranged to receive the leading edge of a second contiguous roof section, and the side edges are each arranged with a downwardly opening channel which is suitably sized and spaced for receipt of corresponding ones of the spaced side walls of the dwelling units.

One object of the present invention is to provide an improved roof structure.

Related objects and advantages of the present invention will be apparent from the following description.

DESCRIPTION OF THE PREFERRED EMBODIMENT

Figure 1:
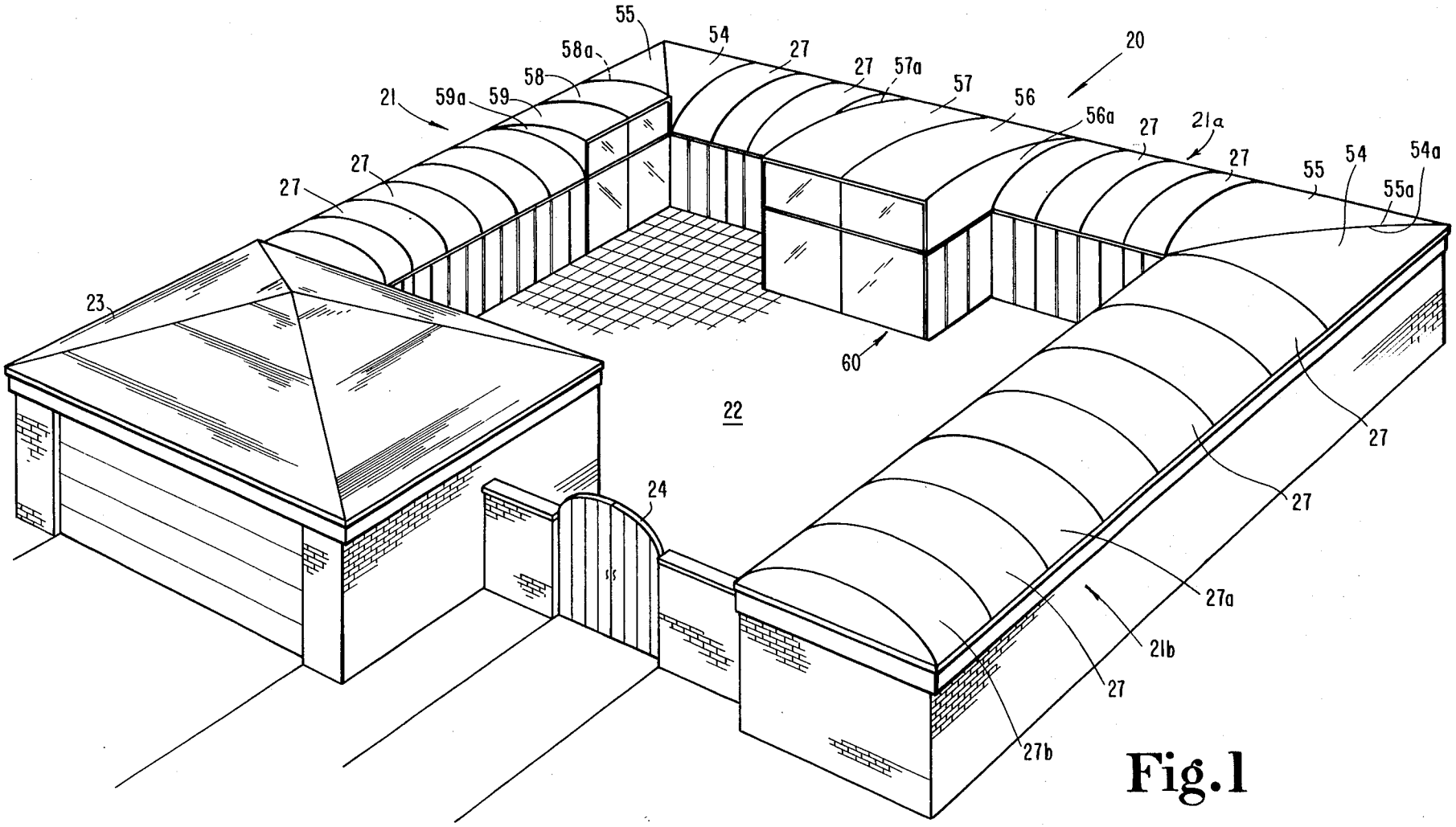
FIG. 1 is a perspective view of a housing unit arranged so as to define an atrium courtyard and including molded roof sections according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

Referring to FIG. 1, there is illustrated a single-family, atrium-courtyard dwelling 20 which is constructed of single-wide housing units 21, 21*a* and 21*b*. These three housing units are arranged on three sides of the atrium courtyard 22 while the fourth side is configured with a garage 23 and security gate 24. Within each housing unit there is an arrangement of individual rooms which are sequentially arranged in single-file manner and these individual rooms may be selectively arranged in sequence according to the preference of the owner (dweller). Although a single-wide arrangement of housing units has been selected as the housing concept for use in combination with the present invention, it is to be understood that the roof construction disclosed herein may be just as easily applied to conventional housing units which are not single-wide and which are not arranged so as to define an atrium courtyard. The preference for the arrangement of FIG. 1 is that it enables the disclosure of a variety of individual roof section shapes and uses, all as part of a single dwelling and a single illustration. A further factor in the selection of single-wide housing units to use in combination with the roof structure of the present invention is the overall width of such housing units. Since these types of housing units are typically fabricated at a remote location and then moved over the road to the construction site, individual state laws regulate how wide the individual housing units may be for over-the-road transportation. Typically, the maximum over-the-road width which is permissible is 14 feet, though the regulated width may vary between 12 and 16 feet, depending on the state. Assuming a somewhat standard width of 14 feet, it is to be understood that the individual roof sections disclosed herein may be molded in 14-foot wide sections thus enabling a single, unitary roof section to span each housing unit from side wall to side wall.

While there is virtually an infinite number of room arrangements which are possible within each housing unit, the width of each unit remains substantially the same and the enclosing configuration of units 21–21*b* which defines the atrium courtyard remains unaffected by the arrangement of the individual rooms within each housing unit. The uniformity in housing unit width enables a standardized roof construction to be employed which saves construction time, skilled labor and material costs. Although there are only seven basic roof section configurations illustrated in FIG. 1, the teachings of the present invention can be utilized to improvise and create a much wider variety of individual roof sections. The roof sections are molded as single, unitary, homogeneous members with a tongue in groove jointing concept for contiguous roof sections and downwardly opening channels for receipt of the side walls, and these features remain consistent regardless of the roof section style. Granted, if the roof sections must span a width dimension for the particular dwelling unit which excedes the dimension which can be safely and reliably molded as a single member, then a tongue-in-groove jointing arrangement or similar assembly technique must be employed not only on the ends of the individual roof sections, but as well on one of the side edges. In this arrangement, in lieu of having two oppositely disposed downwadly opening side edge channels for receipt of the side walls, one of the side edges is configured with one-half of the tongue-in-groove joint and the corresponding roof section which completes the overall width includes the other half of the tongue-in-groove joint. The opposite side edge of the second roof section is thus configured with a downwardly opening channel for receipt of the opposite side wall of the housing unit.

Figure 2:
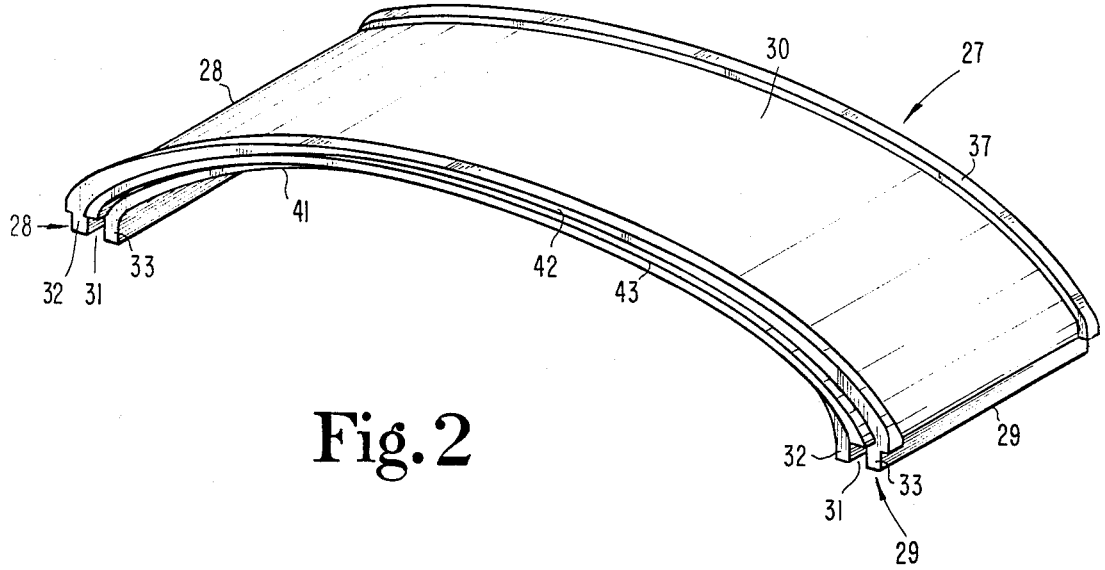
FIG. 2 is a perspective view of a single roof section comprising a portion of the FIG. 1 dwelling unit.
Figure 3:
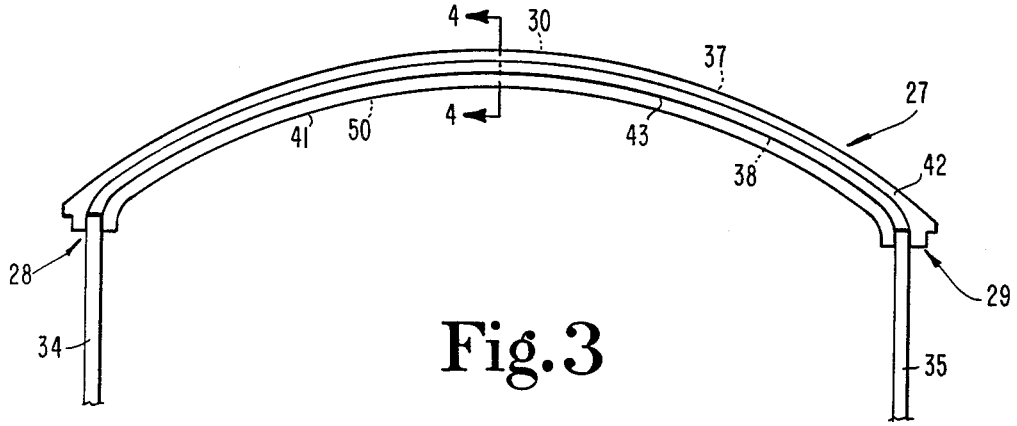
FIG. 3 is an end elevation view in full section of a single roof section as assembled onto housing unit side walls.

Referring to FIGS. 2 and 3, there is illustrated a standard roof section 27 according to a typical embodiment of the present invention. Section 27 is molded out of a synthetic material which in the exemplary embodiment is a high-density polymer foam whose characteristics are similar to that of wood in that it can be worked like wood, sawed, nailed, sanded, painted and glued. The ability of this polymer foam to be molded enables the duplication of intricate designs and elaborate moldings. Due to the fact that the density of this polymer foam can be varied, it actually enables the foam a broader range of use than that enabled by wood. For the exemplary embodiment, a 14-pound per cubic foot density has been selected and this provides both strength and insulation benefits.

The material selected has an R value of 6 per inch of thickness and a compression strength which is greater than most construction woods which would typically be used in roof construction. The material also has a self-extinguishing fire rating and there is no warpage when the material is exposed to water and sun. There is also an ultraviolet screening which is equivalent to that of the paint applied to the outer surface and a weight factor which makes it lighter than most woods. At the present time, this material is offered by Fypon, Inc., 22 West Pennsylvania Avenue, Stewartstown, PA 17363.

The "standard" roof section 27 which is illustrated in FIGS. 2 and 3 measures approximately 14 feet by 4 feet and is 3 inches thick at most points. The 14-foot dimension is actually the projected dimension between side edges 28 and 29 and the main body portion 30 of section 27 is curved or domed upwardly to a maximum height of approximately 30 inches above the lowermost portion of side edges 28 and 29. Each side edge is configured with a wall-receiving channel 31, each of which are bounded by channel-defining sides 32 and 33.

Inasmuch as the individual housing unit side walls 34 and 35 would typically be 3½ inches thick (2×4 lumber), each receiving channel 31 is correspondingly approximately 3½ inches wide and each side 32 and 33 is approximately 3 inches wide. The overall width is thus approximately 9½ inches and this width tapers as roof section 27 curves upwardly such that at the highest point, the thickness of body portion 30 is approximately 3 inches.

As should be understood by reference to FIGS. 1–3, the various roof sections are installed as single units and are suitably sized and arranged to fit down over the individual unit walls which are, in the exemplary embodiment, set to a dimension of 14 feet between outside surfaces. Corresponding, channels 31 have a outside edge to outside edge width dimension which corresponds to this 14-foot dimension and each individual channel has a width which is compatible with the thickness of each side wall such that the roof section may be easily lifted and lowered in place onto the housing unit side walls in one quick and simple step. The FIG. 1 illustration should be considered as more of a schematic diagram inasmuch as certain smaller details of the roof sections have been omitted for drawing clarity.

In accordance with normal or anticipated construction techniques, an appropriate sealant or caulk is applied up into and against the base of each channel 31 for approximately the full extent of each channel so that as the roof section is lowered onto the housing unit side walls, the sealant flows into and around all cracks, crevices and gaps which may exist between the individual roof sections 27 and the housing unit side walls. Any excess sealant which is squeezed out of the joint may be removed and the result is a liquid-tight interface which provides not only sealing against wind and water, but also provides structural stability.

Figure 4:
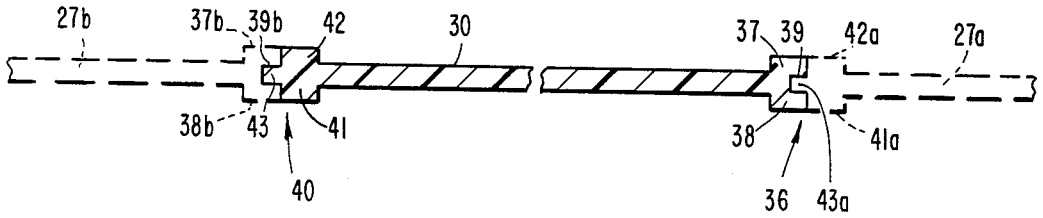
FIG. 4 is a side elevation view in full section of one roof section and illustrating the assembly concept to contiguous roof sections according to a typical embodiment of the present invention.

Since the individual single-wide housing units **21–21*b* typically extend for several feet and since each roof section, in the exemplary embodiment, extends for only approximately 4 feet, several roof sections must be joined together in order to construct a complete roof for each unit. Referring to FIG. 4, the end configuration of a standard roof section is illustrated. In the particular illustration of FIG. 4, the dome or curvature of the body portion 30 extends into and out of the plane of the paper and although portions of the undersurface of this main body portion would technically be visible based upon the location of cutting plane 4—4, this undersurface has been eliminated in this full section view simply for drawing clarity. It is not intended to confuse or mislead as to what is actually being viewed, but since FIG. 4** focuses primarily on the joint between contiguous roof sections, it is believed that elimination of this visible undersurface will benefit the illustration.

The first or leading edge 36 of roof section 27 includes a pair of oppositely disposed strengthening ribs 37 and 38 (omitted in FIG. 1) which extend in opposite directions from main body portion 30. Strengthening ribs 37 and 38 define groove 39 which is generally symmetrical to ribs 37 and 38 as well as to main body portion 30. The opposite, trailing edge 40 includes a pair of oppositely disposed strengthening ribs 41 and 42 and a tongue projection 43 which is symmetrically positioned between ribs 41 and 42 and which is symmetrical to main body portion 30. It is to be understood that strengthening ribs 37 and 38 are virtually identical in size and shape to strengthening ribs 41 and 42, while groove 39 is similarly shaped and dimensioned to tongue 43.

By this particular "tongue-in-groove" assembly concept, the leading edge of one standard roof section 27 receives the trailing edge of a contiguous standard roof section **27*a* by the insertion of tongue 43*a* into groove 39. As this reception occurs, strengthening ribs 37 and 38 are brought into abutment against strengthening ribs 42*a* and 41*a*, respectively, and thereafter a suitable sealant or caulking is applied so as to weatherproof the interface and seal the joint. Similarly, roof section 27*b* is joined to section 27 by the insertion of tongue 43 into groove 39*b* as ribs 41 and 42 are brought into abutment against ribs 37*b* and 38*b*. This particular assembly technique is utilized throughout the remainder of dwelling 20 although there are a few variations as the style of the individual roof sections deviates from that of standard roof section 27**.

In accordance with sound construction techniques and practices, it is recommended that some sealant or caulk be placed into the base of the grooves so as to fill any irregularities or unevenness between the cooperating tongues and grooves. Any mismatch or gaps are believed to be minimal in view of the fact that each roof section is molded and there is an ability to tightly control any tolerance variations, shrinkage and warpage.

It is also to be understood that roof section 27 can be configured with either more or less curvature in the main body portion 30 and in fact roof sections can be configured as completely flat members while still preserving and maintaining all of the teachings of the present invention. For example, in the event it would be desirable as part of dwelling 20 to have a room or series of rooms, a garage or storage area where the roof is substantially flat, then it is a relatively simple and straightforward task to simply mold the individual roof sections as substantially flat members while still preserving the design and configuration of the leading and trailing edges as well as the side edges and thereafter simply allow the same assembly technique to be followed for attaching the roof sections to the side walls and for joining contiguous roof sections to one another.

As previously explained, each roof section, regardless of its size, shape or configuration, is molded as a unitary, homogenous member. Although different grades and densities of foam material can be used, the material is relatively lightweight such that two men can readily and easily lift each standard roof section for assembly onto the housing unit side walls. In addition to the time, skilled labor and cost savings which are realized by the present invention style of roof, as compared to conventional roof construction, the ability to mold the roof sections enables inner surface 50 of main body portion 30 to be configured with decorative shapes, molding, texturing and designs. Since surface 50 is in effect the exposed, interior ceiling surface of each unit, a decorative molding or texturing provides a desirable aesthetic effect and appearance. Since the foam material which is used may also be easily and readily painted, with or without decorative moldings or texturing, the appearance and effect of the molded roof from the interior of the housing units is that of a conventional ceiling.

Although the foregoing illustrations and discussions focus primarily on a single, standard roof section with a curved or domed main body portion, it is to be noted that in order to complete the entire roof for dwelling 20, corner roof sections are required. These corner roof sections 54 and 55 are identified in FIG. 1 and due to the leading edge and trailing edge requirements for the tongue-in-groove assembly of sections 54 and 55 to their contiguous standard roof sections, sections 54 and 55 are in fact different. More particularly, section 54 has a diagonal leading edge 54*a* while section 55 has a diagonal trailing edge 55*a*. While these two edges 54*a* and 55*a* are still configured with the tongue-in-groove approach, their corresponding sections are actually different.

While corner sections 54 and 55 are a requirement, window sections 56, 57, 58 and 59 are optional. Sections 56 and 57 are designed for full height and width extended windows which project out into the atrium courtyard 22. The leading and trailing edge designs are preserved so that sections 56 and 57 are compatible with the adjoining standard roof sections. One additional feature of sections 56 and 57 is the presence of side panels 56*a* and 57*a* which are provided in order to connect the top portion of the roof to the unit side wall. Since the unit side walls are of a uniform height, and since the top portion of sections 56 and 57 do not curve or arc over to contact these side walls, a connecting portion, at substantially a right angle to the top surface, is required in order to fill the gap between the top surface of the roof and the top or upper edge of the corresponding housing unit side wall. This connecting portion or side panel (56*a*, 57*a*) is integrally molded as part of the corresponding roof section. Consequently, for these projected or extended window areas, the roof section which is molded requires a right-angle mold in order to create or provide the L-shaped roof sections.

All other aspects or characteristics of sections 56 and 57 are the same as those provided for the standard roof sections as well as for the corner roof sections. These other aspects or characteristics include consistent design of the leading and trailing edges as well as the side edges with their downwardly opening channels for receipt of the side walls.

Sections 58 and 59 are virtually identical to sections 56 and 57 except that the windows with which sections 58 and 59 are used do not project into the atrium courtyard. Instead, these windows are flush with the side walls of the corresponding housing unit. As a result of this difference, side panels 58*a* and 59*a* are smaller and more triangular in shape than side panels 56*a* and 57*a*. However, all other aspects of sections 58 and 59, including their side edges and their leading and trailing edges, are of the same design as the standard and corner roof sections.

As illustrated, sections 56 and 57 cover room 60 which projects into the atrium courtyard. Since room 60 is wider than 14 feet, the windows and side walls are assembled on site after delivery of units 21–21*b*, if the disclosed dwelling is of a preconstructed nature. This protruding room 60 could be arranged as a bedroom and bath area or as a solarium, and again, the variations are numerous. By providing a variety of different molded configurations for the various roof sections, whether by means of changing the arc or dome of individual standard sections, or by using projecting sections such as sections 56 and 57, attractive variations in the roofline of each dwelling can be created.

Figure 5:
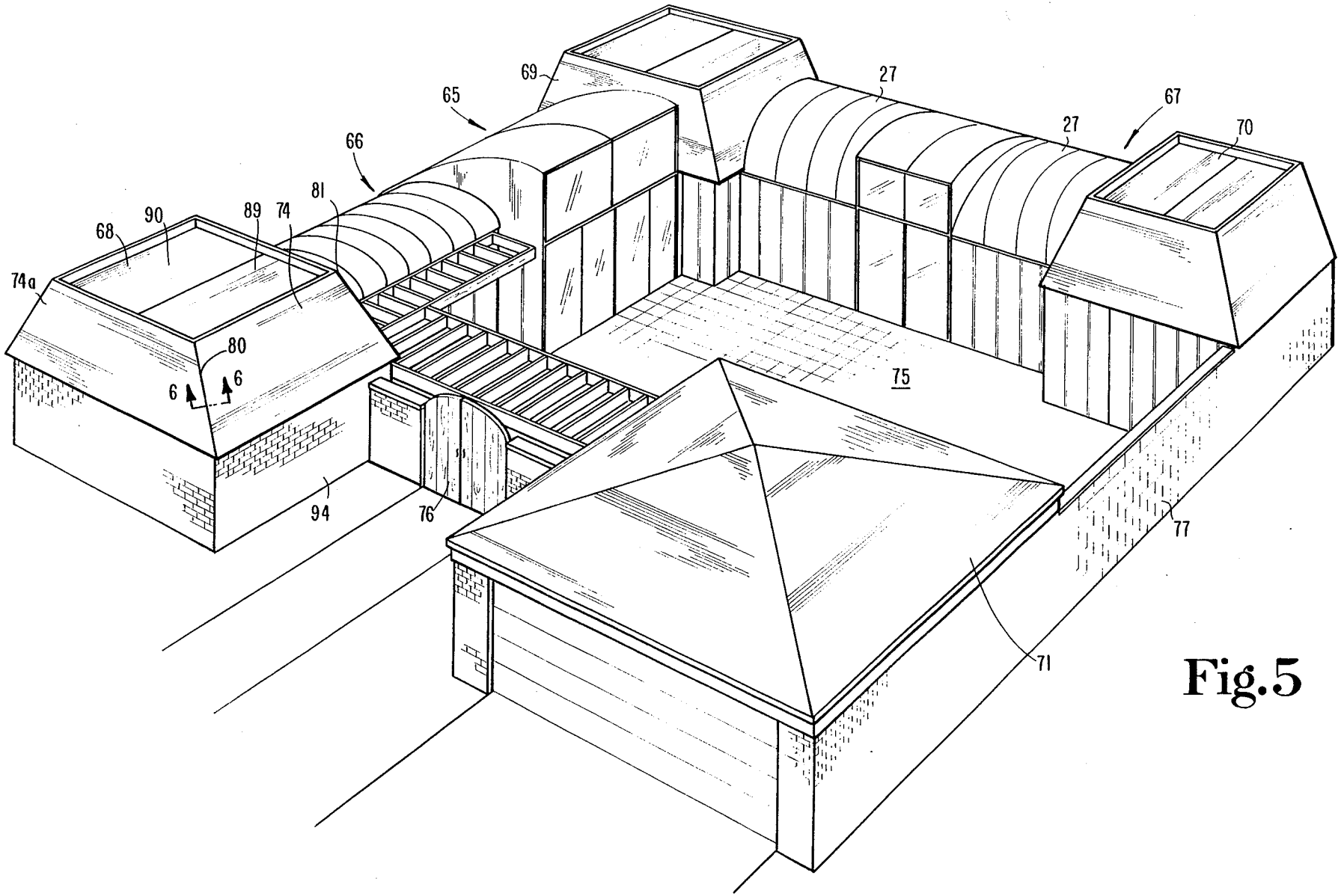
FIG. 5 is a perspective view of an alternative housing unit including molded roof sections according to a typical embodiment of the present invention.

Referring to FIG. 5, an alternative arrangement of roof sections is illustrated as part of dwelling 65. Although portions of dwelling 65 may be brought to the final site as preconstructed housing units, such as units 66 and 67, the uniquely styled corner units 68, 69 and 70 are constructed at the final site. Similarly, garage 71 will also likely be fabricated or constructed at the final site for dwelling 65. Although the various corner units are to be finished at the final site for the dwelling, substantial portions of the construction components may be prefabricated and quickly and easily assembled on site.

For example, roof panels 74 which comprise the outer roof skirt are molded as unitary, single, homogeneous members out of the same high-density polymer foam which is used for standard roof section 27. Although differently configured, shaped and oriented than standard roof section 27, roof panels 74 indicate one more variation and use of the present invention. Although each of the four roof panels for each corner unit are substantially the same, it should be understood that some type of interface will normally be created on at least one side by a standard roof section 27 or by a roof section which is designed for a raised window or window extension. Corner unit 69 illustrates both types of interfaces, and as should be understood, the interfacing joint is adequately sealed so as to make it weatherproof.

It should also be understood from reviewing the FIG. 5 illustration and the arrangement of dwelling 65, that there are certain variations over that of dwelling 20. Dwelling 65 simply offers one further variation, not only as to the roofline and arrangement of various roof sections, but it also offers a variation as to the arrangement of the individual housing units and the layout which creates the atrium courtyard. Still present as part of dwelling 65 is the atrium courtyard 75 and the security gate 76. However, in lieu of a final side arranged or defined by another housing unit, a security wall 77 is illustrated. Wall 77 may be a wall which is common to two single-family dwellings or may merely represent the selected means to close off one side of the atrium courtyard.

Figure 6:
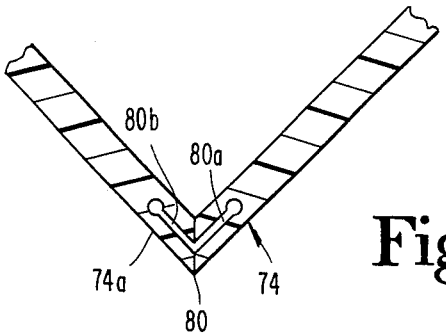
FIG. 6 is a partial, top plan section view of the joint between roof panels as taken along line 6—6 in FIG. 5.

Turning more specifically to the design and construction of roof panels 74, and referring to FIG. 6, it is to be pointed out that each roof panel 74 extends as a full-length, unitary and homogeneous molded foam member from a first corner seam 80 to a second and opposite corner seam 81. Although the design and arrangement of each corner seam or joint is substantially the same. FIG. 6 focuses specifically on seam (joint) 80 which is viewed in FIG. 6 along cutting plane 6—6 of FIG. 5.

As is illustrated, each roof panel 74 and 74*a* has a particular molded thickness and has a seam edge which is molded at a 45-degree angle in the exemplary embodiment so as to enable a right-angled miter joint with the corresponding and abutment edge of the contiguous roof panel. Again, this particular assembly and joint configuration is substantially identical with all roof panels on all corner units. As is illustrated, the edge of each roof panel adjacent the resulting seam 80 includes a corresponding keyway 80*a* and 80*b* which have a unique shape with an enlarged portion at one end and which extend inwardly from the 45-degree bevelled edge of the corresponding roof panel. The substantially rectangular slot which extends from the enlarged end to the corresponding bevelled edge is positioned within the thickness of the corresponding roof panel so as to create the appearance of a continuously open keyway extending from one roof panel to the other and making a right-angle turn at the location of seam 80.

Figure 7:
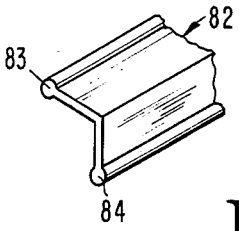
FIG. 7 is a partial perspective view of a spline insert which is used in the FIG. 6 joint.

This continuously created right-angle keyway is then used to lock these two roof panels together by means of a key or spline 82 which is illustrated in FIG. 7.

Spline 82 is an integrally formed homogeneous member which includes two enlarged end portions 83 and 84 which are connected together by substantially flat panels which join together to create a right-angle corner. As intended to be illustrated and as should be understood, spline 82 is sized and configured so as to conform to keyways 80a and 80b with a sliding, yet snug fit. As the spline is inserted into keyways 80a and 80b and is driven in place down the full length of seam 80, roof panel 74 and 74a are locked together. This step is repeated at each edge seam or joint for each of the roof panels of each corner unit.

Figure 8:
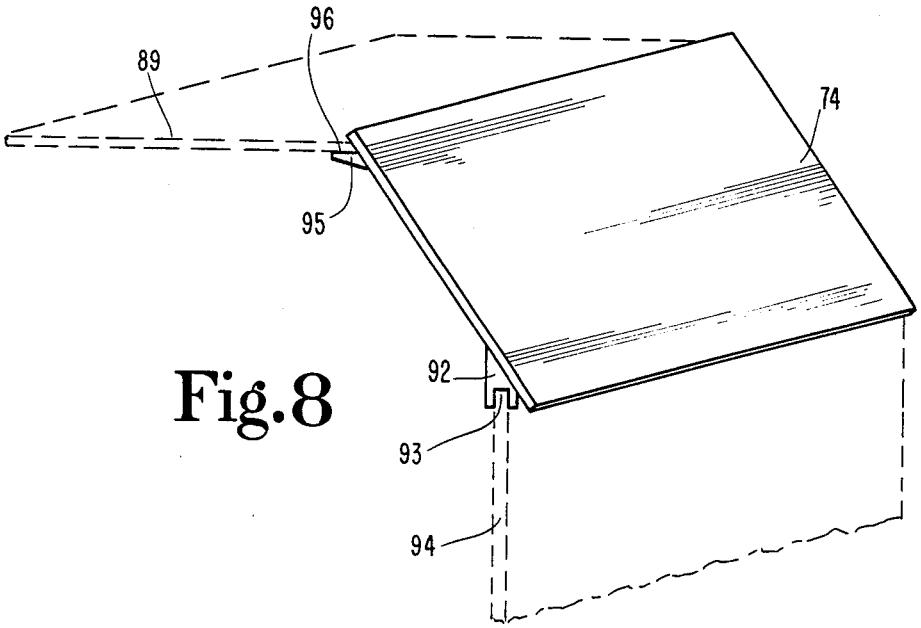
FIG. 8 is a perspective view of a roof panel according to a typical embodiment of the present invention.

The roof construction of each corner unit is completed by substantially flat roof sections 89 and 90 which are joined to one another by a tongue-in-groove joint. The remaining three sides or edges of sections 89 and 90 do not require any particular contouring inasmuch as they simply rest in a defined channel and on a defined support shelf which is molded in as part of each roof panel 74 (see FIG. 8). Referring to FIG. 8, additonal details of roof panel 74 are illustrated. Again, it is to be understood that although we have singled out roof panel 74 for the FIG. 8 illustration, all roof panels are substantially identical and will include the side wall receiving channel and the roof section support shelf and channel as disclosed herein. Roof panel 74 includes a side wall rib 92 which extends the full length of the roof panel. Rib 92 includes two downwardly extending side portions which define side wall receiving channel 93. The illustrated side wall 94 is intended to be representative of one of the four side walls (or possibly three) of corner unit 68. However, the receipt of side wall 94 by channel 93 is substantially the same as the receipt by side walls 34 and 35 by standard roof section 27. Similarly, sealant or caulk is used to complete the weatherproofing of the interface.

Extending lengthwise along the opposite side of roof panel 74 is a roof section support shelf 95 which defines, in combination with the uppermost edge of panel 74, a roof section receiving channel 96. As previously indicated, substantially flat roof sections 89 and 90 are merely lowered in place such that they rest upon shelf 95 as they are extended into channel 96. A suitable caulk or sealant is used to complete the weatherproofing of this particular interface and when completed, a lightweight an durable roof has been assembled by using only preconstructed molded foam sections which are lightweight yet durable and which enable housing unit roofs to be constructed and assembled without necessitating any of the time and cost-excessive steps of conventional roof construction. Although the multicomponent roof style which is used in combination with the illustrated corner units is more complex and involved than the standard roof sections 27, it is also to be noted that much greater versatility can be afforded yet in all cases the teachings of the present invention, the manner in which the roof sections join to the housing side walls and the manner in which the sections are joined to one another is preserved.

Although the tremendous versatility of the present invention is a significant factor, the time, skilled labor and materials savings which are realized are of primary importance. By using molded foam roof sections in lieu of conventional construction, numerous conventional construction steps are eliminated, and the layers of conventional roof material are replaced with a single molded unit.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A molded roof section of high-density polymer foam for use with dwelling units which include spaced side walls, said molded roof section being one of a plurality of roof sections which are sequentially arranged, said molded roof section comprising:

a unitary main body portion arranged with a leading edge, an opposite trailing edge and two side edges, said main body portion having a generally convex outer surface and a generally concave inner surface;

said leading edge being designed and arranged for engagement with the trailing edge of a first contiguous roof section by means of a tongue-in-groove configuration;

said trailing edge being designed and arranged for engagement with the leading edge of a second contiguous roof section by means of a tongue-in-groove configuration;

said side edges each being arranged with a receiving channel, one of said receiving channels being suitably sized and spaced for receipt of a corresponding one of said spaced side walls;

said leading edge including a pair of oppositely disposed strengthening ribs, one rib being integral with said outer surface and the other, opposite rib being integral with said inner surface; and said trailing edge including a pair of oppositely disposed strengthening ribs, one rib being integral with said outer surface and the other, opposite rib being integral with said inner surface.

2. The molded roof section of claim 1 which further includes a side portion extending between said main body portion and a corresponding side edge.

* * * * *